US011084301B2

(12) United States Patent
Schmidt

(10) Patent No.: US 11,084,301 B2
(45) Date of Patent: Aug. 10, 2021

(54) PRINTING METHOD AND PRINTING DEVICE

(71) Applicant: A. SCHMIDT E.K., Forst (DE)

(72) Inventor: Andreas Schmidt, Forst (DE)

(73) Assignee: A. Schmidt e.K., Forst (DE)

( * ) Notice: Subject to any disclaimer, the term of this patent is extended or adjusted under 35 U.S.C. 154(b) by 278 days.

(21) Appl. No.: 16/075,186

(22) PCT Filed: Feb. 3, 2017

(86) PCT No.: PCT/EP2017/052326
§ 371 (c)(1),
(2) Date: Aug. 3, 2018

(87) PCT Pub. No.: WO2017/134193
PCT Pub. Date: Aug. 10, 2017

(65) Prior Publication Data

US 2019/0039386 A1 Feb. 7, 2019

(30) Foreign Application Priority Data

Feb. 5, 2016 (DE) ..... 10 2016 201 821.3

(51) Int. Cl.
*B41J 3/407* (2006.01)
*B41J 11/00* (2006.01)
(Continued)

(52) U.S. Cl.
CPC ..... *B41J 3/4073* (2013.01); *B41J 2/135* (2013.01); *B41J 3/407* (2013.01); *B41J 11/001* (2013.01); *B41J 11/002* (2013.01); *B41J 15/04* (2013.01)

(58) Field of Classification Search
CPC ..... B41J 2/01; B41J 2/135; B41J 3/28; B41J 3/407; B41J 3/4073; B41J 3/4078;
(Continued)

(56) References Cited

U.S. PATENT DOCUMENTS 6,460,958 B2 10/2002 Kubo et al.
6,575,547 B2 * 6/2003 Sakuma ..... B41J 2/195 347/18
(Continued)

FOREIGN PATENT DOCUMENTS

CA 2420285 A1 3/2002
EP 0333609 * 9/1989 ..... B41J 2/01
(Continued)

OTHER PUBLICATIONS

European Patent Office, International Search Report with Written Opinion issued in PCT/EP2017/052326, dated May 30, 2017, 13 pages, European Patent Office, Rijswijk, Netherlands.

*Primary Examiner* — Matthew G Marini
*Assistant Examiner* — Marissa Ferguson-Samreth
(74) *Attorney, Agent, or Firm* — Marshall & Melhorn, LLC

(57) ABSTRACT

A method and a device as provided for printing a large surface which is situated, in particular, on a substrate which cannot be fed to a printing device. The method is distinguished by the fact that the perpendicular spacing Azo of a reference point of the device at a plurality of points which are distributed over the printing web from the surface to be printed is determined in each case at the points which are distributed over the printing web, and the perpendicular spacing Az of the print head from the surface to be printed is set in accordance with a previously recorded measured value. Here, the plurality of points can be distributed uniformly over the length of the printing web. The device for carrying out the method has a measuring device for contactless measurement of the spacing between a reference point of the device and the surface to be printed. Furthermore, the device has a control unit for evaluating the
(Continued)

measured values and producing control pulses for setting the spacing Az of the print head from the surface to be printed.

14 Claims, 4 Drawing Sheets

(51) Int. Cl.
*B41J 2/135* (2006.01)
*B41J 15/04* (2006.01)

(58) Field of Classification Search
CPC ..... B41J 11/001; B41J 11/0015; B41J 15/04; B41J 11/002; D06P 5/30
See application file for complete search history.

(56) References Cited

U.S. PATENT DOCUMENTS

| | | | | |
|---|---|---|---|---|
| 7,044,665 | B2 | 5/2006 | Cannell et al. | |
| 8,882,242 | B2 | 11/2014 | Beier et al. | |
| 9,016,848 | B2 * | 4/2015 | Shimizu | B41J 2/16538 347/102 |
| 2004/0100512 | A1 * | 5/2004 | Codos | B41J 2/01 347/8 |
| 2013/0257984 | A1 * | 10/2013 | Beier | B05B 1/14 347/37 |
| 2016/0185128 | A1 | 6/2016 | Cloots et al. | |

FOREIGN PATENT DOCUMENTS

| | | | | |
|---|---|---|---|---|
| EP | 1313619 | A1 | 5/2003 | |
| EP | 2644392 | A2 | 10/2013 | |
| FR | 2601265 | A1 | 1/1988 | |
| FR | 2601265 | * | 8/1988 | G06T 5/00 |
| FR | 2735420 | * | 12/1996 | B41J 11/001 |
| FR | 2735420 | A1 | 12/1996 | |
| WO | 86/01775 | * | 3/1986 | B41J 2/01 |
| WO | 2015/036267 | A1 | 3/2015 | |

* cited by examiner

PRINTING METHOD AND PRINTING DEVICE

BACKGROUND OF THE INVENTION

The invention relates to a method and a device for printing a large surface, in particular a large surface located on a substrate which cannot be moved toward a printing device. Examples of such surfaces include building walls, walls on trucks or train cars, surfaces on containers or entire sides of ships.

Large format printers have been known in the art for many years. Such printers are able to print paper and other substrates having a width of up to 5 m or even larger, and a theoretically endless length. The printing process is done in a plane, in other words two-dimensionally, using a printing table. In these printers, the printing table is designed more or less linear, i.e. its extent in the width direction perpendicular to the feed direction of the substrate is much larger than in the substrate feed direction. Usually, the substrate is rolled up into a roll in front of the printer and fed thereto, wherein this feeding covers the first axis of the two-dimensional printing process. A printing head moves across the substrate perpendicular to this axis and comprises a pigment application system. A widely-marketed printer is the ink-jet printer, wherein the pigment is an ink sprayed as droplets onto the substrate using nozzles controlled by a controller. A plurality of nozzles for different pigments can be disposed next to one another in the printing head, making multi-colored printing possible. The printing plane usually corresponds to the horizontal plane. Due to the feeding process, the substrate must be flexible, at least in the longitudinal direction.

Flat bed printers are also well known. These types of printers hold the substrate in a bed, called the printing table. The printing head is fastened to a cross table, allowing the printing head to move in both planar directions. Flat bed printers like these also make it possible to print onto solid substrates. The dimensions of such cross tables are finite and cannot be arbitrarily enlarged since the axes of the cross table can only be mounted at the axis end points, and only require minimum stability. The substrate is fed to the printer in flat bed printers as well.

In both systems, by feeding the substrate to a printing table the distance of the printing head in the spatial direction, i.e. perpendicular to the plane spanned by the x- and y-directions, called the z-direction here and further below, is constant and precisely defined. This distance is important if a clean printed image is to be achieved. The ink jets are focused on this distance.

Neither system is able to print on the surface of a stationary substrate, for example the wall of a room or building.

Recently, wall printers have become known which facilitate wall printing. These printers use printing heads from commercially-available ink-jet printers, the heads being fixed to an axis and movable in a direction identified here and further below as the vertical direction, or the y-direction. This axis is fastened to a moving frame, wherein the moving frame is movable in a direction substantially perpendicular to the vertical direction, identified here and further below as the horizontal direction or x-direction. The printing principle is the same as the large format printer described above: The vertical direction of the printing head is achieved by way of the upward and downward motion thereof in the y-direction, whereas the horizontal direction is achieved by way of the motion of the moving frame in the x-direction. The printing head then prints a vertical track in the y-direction at a spread defined by the printing head, i.e. a track width in the horizontal direction. For printing an adjacent track in the horizontal direction, the moving frame is moved in the x-direction past a wall while the printing head remains in the upper or lower end position. In practice, however, there are some problems: If the floor is not level, which is usually the case in tiled floors, for example, due to the joints between the tiles, these uneven places transfer to the printed image. To solve this problem, known wall printers move along a rail system which bridge such uneven places. The disadvantage to this is that the rails must be designed and adjusted, which requires effort, and on the other hand long rails are required for long walls to be printed, which increases the effort to transport the wall printer to a point of use, the costs for the wall printer and in turn the effort required to perform the printing.

Another problem in known wall printers is the limited height of the printable area: The y-axis comprises a profile of a fixed length of usually 2 m, wherein the print head motion along this axis is done by way of a toothed belt. Thus, the length of the y-axis cannot be extended, or only with a very large amount of effort. Moreover, the y-axis is fixed and designed to this length so that extending the axis would lead to a very unsatisfactory printed image due to mechanical instability and fluctuations in the x- and z directions as a result. Also, walls of building structures are rarely perfectly vertical relative to the floor, but are usually tilted relative thereto. In most cases, the inclination is only a few angular degrees. However, above a room height of usually about 2.50 m for residential buildings and much more for commercial buildings, even just 1° of inclination makes a difference of over 4 cm, which causes the printed image to appear very different with respect to contour sharpness between the bottom and the top ends. In the prior art, there are known uses of ultrasonic sensors for measurement purposes to reposition the distance of the printing head relative to the wall. These sensors are attached to the printing head and are therefore only capable of detecting the distance in real time, i.e. at the moment in which the printing head is located at the respective position. A re-adjustment based on such a measurement can only be very incomplete due to the dead time between the measurement and the re-adjustment. Moreover, a wall can also have unevenness in it, which can destroy the printed image if the printing head collides with the wall. The y-axis in known wall printers is mounted more or less in the x-direction on the moving frame, at least it is not mounted at an end of the x-axis of the moving frame. This makes it impossible to print into a corner. In other words, there are always strips of more or less width which cannot be printed in room corners. The rails for the moving frame can only be moved straight, i.e. printing of curved surfaces is not possible. Even today, it is only possible to print on surfaces that are perpendicular to the floor on which the moving frame moves. Printing on surfaces that are aligned differently than this, for example ceiling or floor surfaces, is not possible. It is certainly not possible to print on three-dimensional surfaces, for example bulged ceilings.

SUMMARY OF THE INVENTION

The problem to be solved by the invention is therefore to provide a method for printing a large surface, in particular a large surface located on a substrate which cannot be moved toward a printing device, said method not having the limitations and disadvantages described above. Furthermore, the problem to be solved by the invention is to provide a device for carrying out this method.

According to the invention, this problem is solved by way of a method having the features of independent claim 1. Advantageous improvements of the method can be found in dependent claims 2-6. The problem is further solved by a device according to claim 7. Advantageous embodiments of the device can be found in dependent claims 8-13.

The method according to the invention is suitable for printing on a large surface located on a substrate which cannot be moved toward a printing device. Surfaces such as walls, buildings trucks or train cars, surfaces on containers, etc., wherein the surface to be printed can be subdivided into print track in one direction corresponding to the printing width of a printing head and wherein the printing head is fastened to a first axis movable along a print track, the first axis is fastened to a moving frame which can move in the horizontal x-direction, and wherein the surface can be printed by way of sequentially printing the print track. The method is characterized in that the perpendicular distance $A_{zo}$ of a reference point of the device is determined at a plurality of points distributed over the print track relative to the surface to be printed, and the perpendicular distance $A_z$ of the printing head from the surface to be printed is adjusted at the points distributed over the print track according to a previously recorded measured value. The plurality of points can be evenly distributed over the length of the print track. In deciding as to the number of points, the evenness of the surface to be printed and/or the expected number and extent of disrupting points on the surface to be printed can be taken into account. In a very flat surface without any appreciable disrupting points, a few points would suffice, whereas for uneven surfaces with many disrupting points, in particular if at least some of these disrupting points have large dimensions, many measurement points should be recorded. In extreme cases, the number of measurement points can be selected to be so large that a quasi-continuous measurement process takes place. The recorded measured values for each print track for each point measured along the print track can be saved as a measurement series, wherein a trend is determined from the measured values of at least one measurement series, wherein a steering motion of the moving frame which moves in the horizontal direction is triggered when the trend exceeds a pre-defined threshold. For example, if the surface to be printed is a wall which is substantially perpendicular to the floor surface along which the moving frame moves, the frame being movable in the horizontal direction, for example a wall of a living space, a steering motion of the moving frame is triggered when the distance of the wall from the moving frame changes during the motion thereof, for example due to the wall direction tilting away or the wall describing a curve. The measured values of every measurement at a specific height are collected in the control unit into a measurement series and a trend is calculated. If the trend of at least one measurement series changes beyond a pre-determined threshold, a steering signal is issued from the control unit to the moving frame so that the distance of the moving frame from the wall moves back to the previously established corridor. In this fashion, it is possible to print walls that follow a curved profile or whose profile changes relative to an initially described direction.

The device for carrying out the method comprises a measuring device for non-contact measurement of the distance between a reference point of the device and the surface to be printed. The device further comprises a control unit for evaluating the measured values and for generating control signals for adjusting the distance $A_z$ of the printing head from the surface to be printed.

Adjusting the distance $A_z$ of the printing head from the wall to be printed solves the problems of the prior art with regard to a printed image with sharp contours despite the lack of a precisely flat and equidistant alignment of the surface to be printed with respect to the printing head. In order to adjust the distance $A_z$ of the printing head at every location on the print track such that it is always the same despite unevenness or a wall that is not vertical, for example, the distance $A_z$ must be determined. In a preferred embodiment, this is done in a non-contact manner, preferably optically, for example using a laser distance meter. Since the distance $A_z$ of the printing head from the surface to be printed is adjusted such that it always has the same distance $A_z$, the printing head cannot collide with any unevenness on this surface, for example. The measurement is done using a reference point of the device. For example, this reference point can be located at the first axis at which the printing head moves along a print track. In this way, the reference point is moved in common with the printing head along a print track so that the distance $A_{zo}$ of the reference point to the corresponding printing head positions is known. Using the known geometric relationships of the device, the required printing head position with regard to distance $A_z$ from the surface to be printed can be determined. A corresponding distance measuring device can be attached at the reference point. The reference point can be located next to the printing head in the horizontal x-direction so that the distance $A_{zo}$ of the reference point from the surface to be printed precedes the printing head when printing in one direction. This is the preferred printing direction. Precession means that the distance is already measured while the printing head is still traversing the previous print track. This gives the control unit a head start to calculate the printing head distance $A_z$ from the surface to be printed.

In a preferred embodiment of the inventive method, at the beginning of a print process the first print track is traversed without the printing head being activated, wherein the perpendicular distance $A_{zo}$ of a reference point of the printing head to the surface to be printed is determined in advance for the print track traversed during the measurement, said determination being made at a plurality of points distributed over the vertical print track. The printing head traversed the first track of the printed image without performing any printing. It is advantageous for the printing head for this run to be in a position as far away as possible from the surface to be printed. In this run, it is only the distance measurement device that is active. The distances recorded are sent to the control unit, where a calculation is done to ascertain the position of the printing head for a constant distance $A_z$ of the printing head from the wall for each position on the print track. Then, the same print track is re-traversed, wherein this time the print head is active and the surface below the track is printed.

In an advantageous embodiment, the starting position of the printing head is visually displayed at the beginning of a print track. In an especially advantageous embodiment, the starting position of the printing head at the beginning of each print track is visually displayed. To this end, the printing head is provided with an optical display unit. This optical display unit can be a laser lamp, for example. In particular, the optical display unit can be a laser pointer. A laser pointer projects a point of light onto the substrate to be printed in a known fashion and indicates the point at which the printing head is located. If this position is not identical to the position where the print track begins, the printing head can be correspondingly re-adjusted.

It has proven to be advantageous if the printing is done by applying ink onto the substrate, wherein the ink is maintained at a temperature of about 43° C. To this end, the device uses a corresponding temperature controller. The printing is done using a known ink-jet printing head which can have a plurality of nozzles, for example for multi-color printing. In the process, it is fundamentally possible to use different inks, in particular, if the surface to be printed is located outside and under the effect of the weather, it is advantageous to use a water-resistant and UV-stable ink that can withstand wetting due to rain and solar radiation, at least for a certain period of time. Such inks can be processed optimally at a temperature of about 43° C., wherein the processing temperature interval is about 1K. It has proven to be advantageous if the ink is maintained in bags and fed from bags, wherein the bags are made of an aluminum alloy. In an advantageous embodiment, the ink bags are stored in the device on individual surface heating devices in the form of plates, wherein the heating output of the surface heaters is regulated, wherein the respective actual temperature of the surface heaters is recorded using a sensor and the information is sent to a control device. The aluminum alloy of the ink bags has good heat conductivity so that the ink temperature can be easily controlled by way of the temperature of the surface heaters.

In another advantageous embodiment, the printing head is shaded from UV radiation using a device when the print head is not active. To this end, the device uses a movable shading unit. Inks that have good water resistance and UV stability and which also have good properties with regard to color brilliance and wear resistance are those that cure under UV light, for example. After the ink has been applied to the substrate, it cures under UV light, i.e. the monomers in the ink polymerize and the ink pigments become fixed in the solid polymer layer. Therefore, these inks should be shaded from UV light if they have not yet been applied to the substrate. To this end, the device has a device in the form of a stored movable plate which can be pushed over the printing head when the head is inactive. If the printing head comprises a plurality of nozzles, for example for different inks, the plate can have a plurality of openings which cover the different nozzles or which after shifting the plate reveal the nozzles again for printing. In one embodiment, the plate is a stainless steel sheet with a path of motion of 4 mm for example.

It is conceivable that the printing head is pivoted depending on the alignment of the surface to be printed so that the printing head is always aligned substantially perpendicular to the surface to be printed. Walls of buildings can have projections or recesses, for example, wherein the wall profile proceeds at an angle toward the projection or recess. By pivoting the printing head, it is possible to print those wall parts that proceed at an angle. It is also possible to print ceilings or floors. In particular, it is also possible to print bulged ceilings, for example, in which a wall extends in a direction continuously to form a wall, in other words in a direction tilted substantially perpendicular relative to the original direction of the wall surface.

A device according to the invention for printing large surfaces, in particular surfaces located on a substrate which cannot be moved toward a printing device, such as walls of buildings, trucks or train cars, surfaces on containers, etc., surfaces which can be subdivided into print tracks in one direction corresponding to the printing width of a printing head, wherein the printing head is fastened to a first axis movable along a print track, wherein the first axis is fastened to a moving frame which can move in the horizontal x-direction, and wherein the surface can be printed by way of sequentially printing the print tracks, characterized in that the distance $A_z$ of the printing head from the surface to be printed is adjustable and the device comprises a measuring device for measuring the distance $A_{zo}$ between the reference point of the device and the surface to be printed in a non-contact manner and the device further comprises a control unit for evaluating the measured values and for generating control signals for adjusting the distance $A_z$ of the printing head from the surface to be printed.

The moving frame can move in the horizontal x-direction, wherein the moving frame is designed to be steerable and the device further comprises a control unit for calculating the steering angle of the moving frame. The recorded measured values for each print track for each point measured along the print track are saved as a measurement series, and a trend is determined from the measured values of at least one measurement series, wherein a steering motion of the moving frame which moves in the horizontal direction is changed when the trend exceeds a pre-defined threshold.

It is conceivable for the printing head to be movably mounted at a third axis along a print track and pivotable at least by 180° horizontally. The pivoting character of the printing head makes it possible to print spatially oblique surfaces. It is also possible to print walls or floors. Finally, it is even possible to print surfaces the spatial alignment of which continuously changes, such as in the case of bulges.

In another advantageous embodiment, the device comprises an extendable first axis for moving the printing head along a print track, wherein the first axis comprises a rack. By use of a rack, the first axis is easily extendable by applying another axis module, likewise equipped with a rack, onto the existing first axis. In one embodiment, a unit supporting the printing head comprises a servomotor that drives a pinion which engages with the rack of the first axis, whereby the unit supporting the printing head very precisely and without jerking can move along the first axis, even if the first axis is extended.

In another advantageous embodiment, the device comprises a second axis for adjusting the distance $A_z$ of the printing head from the surface to be printed, wherein the second axis comprises a spindle. It is advantageous for the second axis to be part of the unit which supports the printing head. It has proven to be advantageous for the spindle to be driven by a servomotor. This allows the distance $A_z$ of the printing head from the surface to be printed to be very precisely and quickly adjusted.

The moving frame has wheels for placement on a floor and movement in the horizontal x-direction. It has been shown to be advantageous for the moving frame to be provided with at least three, in particular four wheels, wherein the wheels are disposed at the respective corners of the frame. Each wheel can have an adjustable height compensator. The moving frame itself can have a measuring device for checking the horizontal alignment of the moving frame. In addition, the moving frame can have a distance measuring device at the corners thereof near each respective wheel. This measurement is preferred to be non-contact, preferably as an optical measuring device. Furthermore, the moving frame can have a control unit for activating the height compensator for each wheel depending on the measurement results of each distance measuring device, such that the moving frame is self-leveling at all times, in particular when the floor is tiled, for example, and when the floor has joints between the tiles which are lower than the tiles. Moreover, an activated height compensator of each wheel has the advantageous effect of maintaining non-jerking horizontal movement of the moving frame.

The device can have a device for shifting the printing head in the direction or away from the direction of motion of the moving frame, in particular by way of a third axis in said direction. This third axis can serve to provide movement of the printing head to the end points or beyond the end points of the moving frame in the direction of motion thereof. If the surface to be printed is, for example, a wall of a living space, the third axis makes it possible to print into the corners and to minimize or even eliminate areas of the wall in the direction of motion of the moving frame that cannot be printed due to the required extension of the moving frame in the direction of motion.

The moving frame is able to move forward and backward in the direction of motion. The frame comprises a motor for this purpose. This motor can be a stepper motor or a servomotor. One wheel or a plurality of wheels can be driven to provide the motion. The wheel or wheels can be driven directly or by way of a gear, wherein the wheel or wheels can be connected to the motor rigidly or by way of a transmission unit, for example a chain or a belt, for example a toothed belt.

To achieve the function of pivoting of the printing head, there are the alternatives of only pivoting the printing head or pivoting a printing head support unit consisting of the third axis aligned in the direction of motion of the moving frame together with the printing head.

Other advantages, unique features and useful improvements of the invention can be found in the dependent claims and the following preferred exemplary embodiments illustrated in the figures.

DETAILED DESCRIPTION OF THE INVENTION

Figure 1:
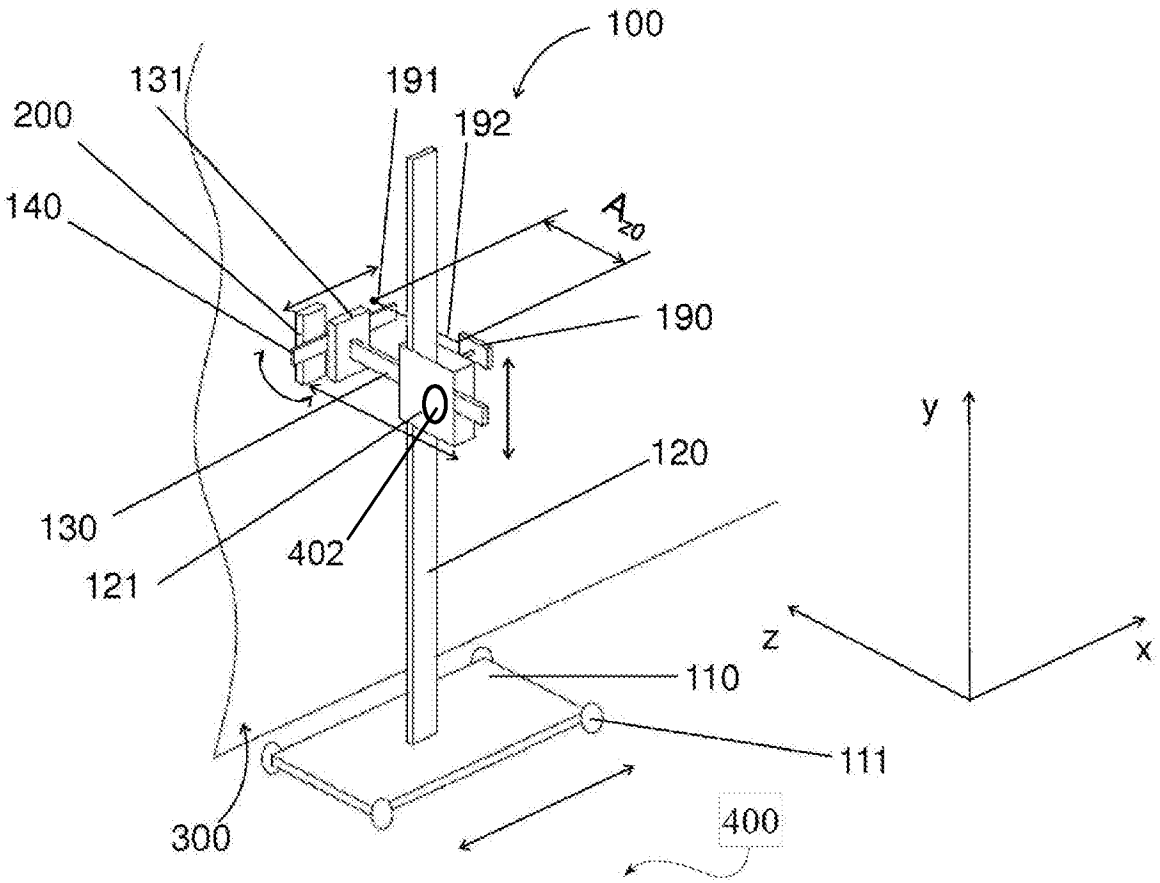
FIG. 1 A device according to the invention in a three-dimensional principle sketch FIG. 2 The device according to the invention in a top view for printing a wall surface FIG. 3 The device according to the invention in a top view for printing a wall surface near a wall corner

FIG. 1 shows a device according to the invention 100 in a three-dimensional principle sketch Device 100 comprises a moving frame 110 movable on four wheels 111 in the horizontal x-direction on the floor 400. A distance measuring device (not shown) is provided at the corners of the moving frame 110 near each wheel. This device optically measures the distance to the floor 400 and forwards the measurement signal to a control unit 402. Each wheel 111 has an adjustable height compensator (not shown). The height compensator of each wheel 111 can be activated depending on the measurement results of each distance measuring device such that the moving frame 110 is self-leveling at all times, in particular when the floor 400 is tiled, for example, and when the floor has joints between the tiles which are lower than the tiles. The device 100 further comprises a first axis 120 in the y-direction. This first axis 120 comprises a rack fastened to the axis in the y-direction. The first axis 120 can be designed in a standard industry profile, wherein the rack is lowered into the profile and protected therein. The first axis 120 can be extended by placing one or more axis modules onto the first axis, the one or more axes likewise being designed in the standard industry profile. The attachable axis modules also comprise a rack. For example, the first axis 120 is about 2.50 m long in the un-extended embodiment, so that it can be used in residential buildings having standard ceiling heights. If higher surfaces 300 are to be printed, for example in a commercial property or an exterior façade, the first axis 120 is extended using corresponding axis modules so that print track of more than 2.50 m in length can be printed.

A second axis 130 is attached to the first axis 120 using a sled 121, the second axis having a primary extension in the z-direction. The sled 121 has a drive in the form of a servomotor and a pinion which engages with the rack of the first axis 120. The upward and downward motion that the second axis 130 and a printing head 200 fastened to the second axis 130 can make can permit a print track to be traversed and printed in the y-direction by the printing head 200. After this print track is prepared, the device 100 can shift in the x-direction by one print track width by way of the device 100 using the moving frame 110 so that the next print track can be printed. A measuring device 190 in the form of a laser distance meter is fastened to the sled 121. This measuring device issues a measurement beam 192 in the direction of the surface 300 to be printed, where the beam hits a measurement point 191. The distance of the measuring device 190 from the surface 300 to be printed in this point is recorded and sent to the control unit 402 of the device 100 as reference distance $A_{zo}$ which is stored in the control unit 402. The second axis 130 comprises a spindle. In the sled 121, there is a further servomotor for driving the spindle. By evaluating the reference point distance $A_{zo}$ in the control unit 402, the current distance $A_z$ of print head 200 from the surface 300 to be printed can be determined. This distance can be rapidly and precisely adjusted to a pre-determined set point filed in the control unit 402 by way of the servomotor and the spindle. This allows the distance $A_z$ of the printing head from the surface to be printed to be very precisely and quickly adjusted.

An axis head 131 is attached to the second axis 130 at the end thereof facing the surface 300 to be printed. This axis head 131 hides a servomotor which drives a third axis 140 aligned in the x-direction, i.e. the direction of motion of the moving frame 110. The printing head 200 is fastened to this third axis 140 and is movable in the x-direction. This allows the printing head 200 to be moved independently of the motion of the moving frame 110 in the x-direction.

This provides an advantage when printing is to be done in the corner of a wall, wherein an un-printable area is to be minimized.

The third axis 140 is pivotably mounted at the axis head 131, wherein the pivot range is at least 180°. This allows the printing head 200 to be pivoted both upward, allowing a room ceiling to be printed, for example, and downward, allowing the floor on which the moving frame 110 movably sits to be printed.

For printing a room ceiling, the second axis 130 can also be rotatably attached in the sled 121 together with the axis head 131, the third axis 140 and the printing head 200, wherein the rotating motion covers at least 90° so that a corresponding rotation upward allows the ceiling to be printed.

Figure 2:
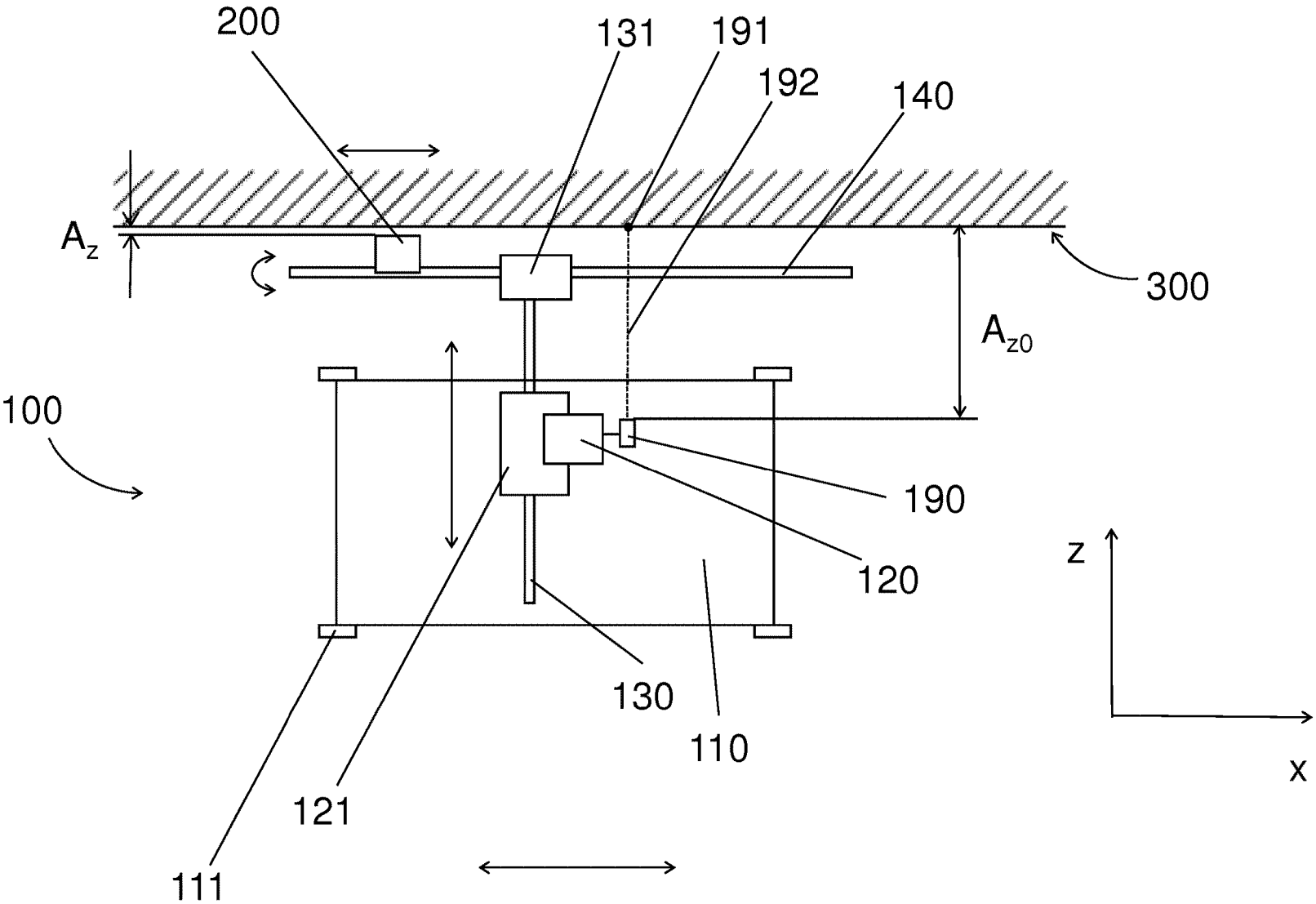

FIG. 2 shows the device 100 while printing a wall surface 300 in a top view. At least two wheels 111 can be steered so that the moving frame can also follow a curving wall. The device comprises the control unit 402, shown in FIG. 1, for calculating the steering angle of the moving frame 110. The recorded measured values $A_{zo}$ for each print track for each point measured along the print track are saved as a measurement series, and a trend is determined from the measured values of at least one measurement series, wherein a steering motion of the moving frame 110 which moves in the horizontal direction is changed when the trend exceeds a pre-defined threshold.

Figure 3:
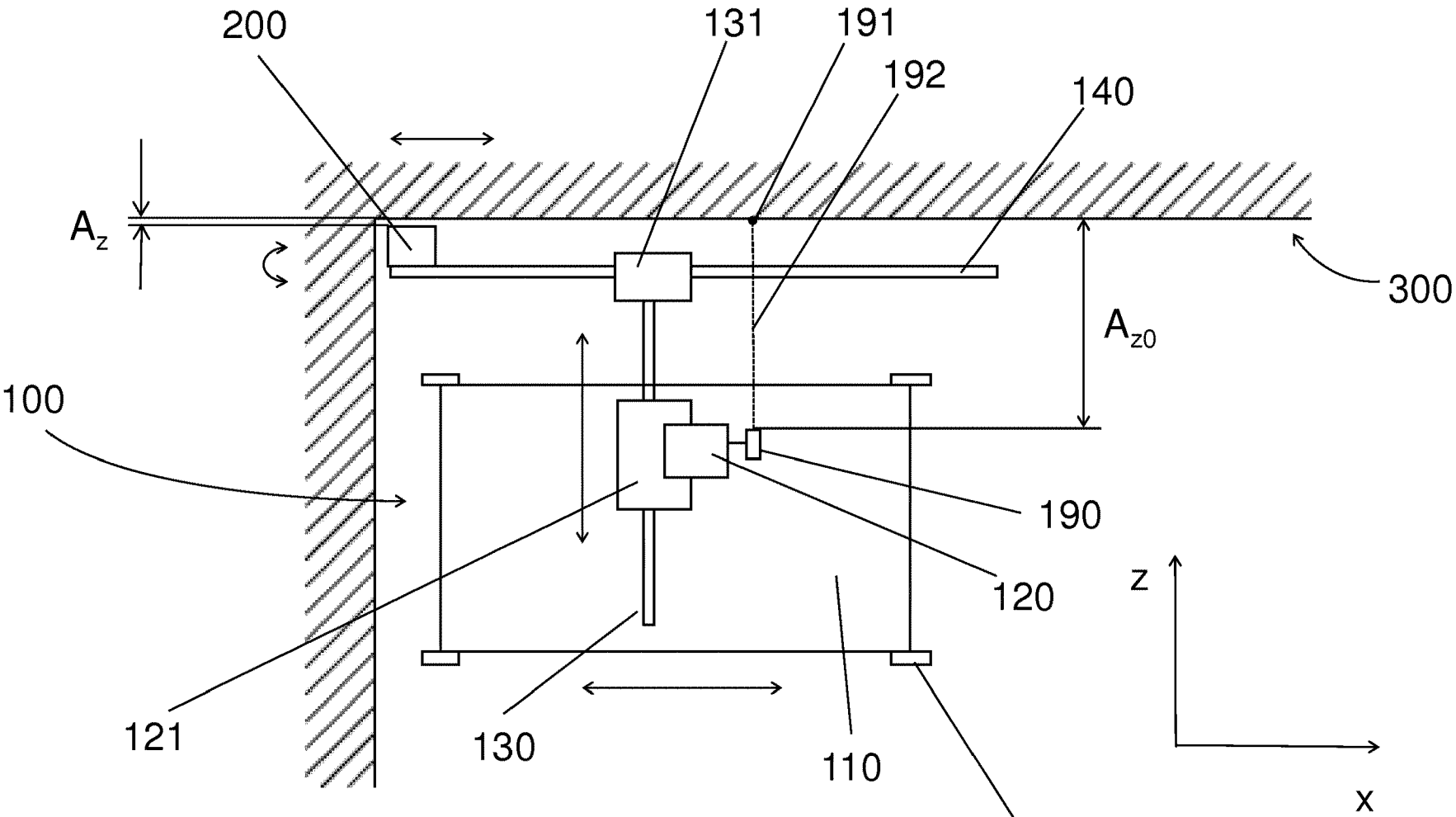

FIG. 3 shows the device 100 while printing a wall surface 300 in a top view, wherein the device 100 is located in a corner, formed by two walls. The printing head 200 is moved to the end of the third axis 140 at the corner in order to print into the corners and to minimize or even eliminate areas of the wall 300 in the direction of motion of the moving frame 100 that can't be printed due to the required extension of the moving frame 100 in the direction of motion.

Figure 4:
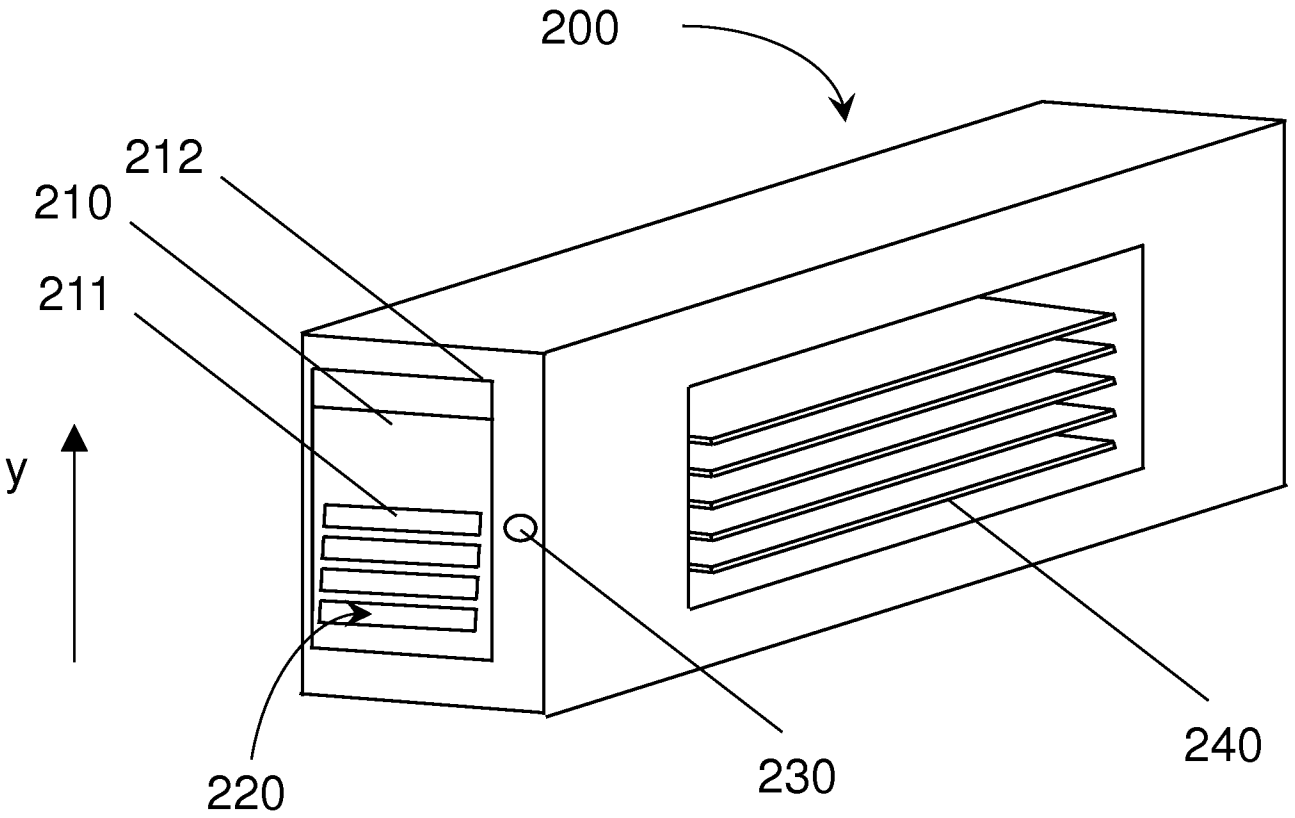
FIG. 4 shows a printing head 200 according to the invention in a principle sketch

FIG. 4 shows a printing head 200 according to the invention in a principle sketch. The printing head 200 comprises four nozzles 220 which are disposed behind a shading plate 210. The shading plate 210 comprises four slots 211, wherein the shading plate 210 is mounted in a guide 212 which can move in the y-direction so that the nozzles 220 can be shaded against UV radiation by the shading plate when the nozzles are inactive. The printing head 200 further comprises a laser pointer 230 for displaying the position of the printing head 200 at the beginning of a print track on the substrate to be printed. The printing head 200 comprises plates 240 regularly disposed one above the other inside the printing head 200. The plates 240 use a temperature controller. Certain inks are optimally processed at a temperature of about 43° C. The ink is maintained in bags and fed therefrom, wherein the bags are made of an aluminum alloy. The ink bags are kept inside the printing head 200 on individual surface heating devices disposed on the plates 240.

The embodiments shown here only represent examples of the present invention and therefore may not be understood to be limiting. Alternative embodiments considered by a person skilled in the art are also within the protective scope of the present invention.

LIST OF REFERENCE SIGNS

100 Device for printing large, immovable surfaces
110 Moving frame
111 Wheel
120 First axis, y-axis
121 Sled
130 Second axis, z-axis
131 Axis head
140 Third axis, x-axis
190 Measurement device
191 Measurement point
192 Measurement beam
200 Printing head
210 Shading plate
211 Slot
212 Guide
220 Nozzle
230 Laser pointer
240 Plate
300 Surface to be printed, wall
400 Floor

What is claimed is:

1. A method for printing a large surface, in particular a large surface located on a substrate which cannot be moved toward a printing device, wherein a printing head is fastened to a first axis movable along a print track, wherein the print track is at least a portion of the surface corresponding to a printing width of the printing head, wherein the first axis is fastened to a moving frame which can move in a horizontal x-direction, and wherein the surface can be printed by way of sequentially printing at least one print track, wherein a perpendicular distance Azo of a reference point of the printing device is measured by a control unit at a plurality of points distributed over the print track relative to the surface to be printed, and a perpendicular distance Az of the printing head from the surface to be printed is adjusted at each of the plurality of points distributed over the print track according to the measured perpendicular distances Azo, wherein the measured perpendicular distance Azo for each reference point measured along the print track is saved in at least one measurement series, and a trend is determined by the control unit from the measured perpendicular distances Azo of the at least one measurement series, wherein a steering motion of the moving frame which moves in the horizontal x-direction is changed when the trend exceeds a pre-defined threshold.

2. The method according to claim 1, wherein at a beginning of a print process a first print track is traversed without the printing head being activated, wherein the perpendicular distance Azo of the reference point of the printing device to the surface to be printed is determined in advance for the first print track being traversed during a measurement, a determination being made at a plurality of points distributed over the first print track.

3. The method according to claim 1, wherein a start position of the printing head is visually displayed at a beginning of the print track.

4. The method according to claim 1, wherein the printing head is pivoted depending on an alignment of the surface to be printed so that the printing head is always aligned substantially perpendicular to the surface to be printed.

5. The method according to claim 1, wherein the printing is done by applying ink onto the substrate, wherein the ink is maintained at a temperature of about 43° C.

6. The method according to claim 1, wherein the printing head is shaded from UV radiation by way of a device when the printing head is not active.

7. A device for printing a large surface, in particular a large surface located on a substrate which cannot be moved toward a printing device, wherein a printing head is fastened to a first axis movable along a print track, wherein the print track is at least a portion of the surface corresponding to a printing width of the printing head, wherein the first axis is fastened to a moving frame which can move in a horizontal x-direction, and wherein the surface can be printed by way of sequentially printing at least one print track, wherein a distance Az of the printing head from the surface to be printed is adjustable and the printing device comprises a measuring device for measuring in a non-contact manner a distance Azo between a reference point of the printing device and the surface to be printed and that the printing device further comprises a control unit for evaluating the measured distances Azo and for generating control signals for adjusting the distance Az of the printing head from the surface to be printed, wherein the moving frame can move in the horizontal x-direction, wherein the moving frame is designed to be steerable, and wherein the control unit calculates a steering angle of the moving frame.

8. The device according to claim 7, wherein the measuring device for measuring in the non-contact manner the distance Azo between the reference point of the device and the surface to be printed comprises a laser distance meter.

9. The device according to claim 7, wherein the printing head comprises an optical sensor for detecting a starting point of the printing head at a beginning of the print track.

10. The device according to claim 7, wherein the device comprises an extendable first axis for moving the printing head along the print track, wherein the first axis comprises a rack.

11. The device according to claim 7, wherein the device comprises a second axis for adjusting the distance Az of the printing head from the surface to be printed, wherein the second axis comprises a spindle.

12. The device according to claim 7, wherein the device uses a temperature controller for maintaining a temperature of an ink at a temperature of about 43° C.

13. The device according to claim 7, wherein the device uses a movable shading unit for shading the printing head from UV radiation during non-use thereof.

14. A method for printing a large surface, in particular a large surface located on a substrate, the method comprising the steps of:

providing a measuring device;

providing a printing device including a printing head fastened to a first axis thereof, wherein the printing head is movable along a print track, wherein the print track is at least a portion of the surface, wherein the first axis is fastened to a moving frame of the printing device;

providing a control unit in communication with the measuring device and the printing device;

measuring, via the measuring device, a perpendicular distance Azo of a reference point of the printing device at a plurality of points distributed over the print track relative to the surface to be printed;

adjusting, via the control unit, a perpendicular distance Az of the printing head from the surface to be printed at each of the plurality of points distributed over the print track according to the measured perpendicular distances Azo;

generating, via the control unit, at least one measurement series from the measured perpendicular distance Azo for each reference point along the print track;

determining, via the control unit, a trend from the measured perpendicular distances Azo of the at least one measurement series;

adjusting, via the control unit, a steering motion of the moving frame when the trend exceeds a pre-defined threshold, wherein the moving frame is configured to move in at least one of a horizontal x-direction; and printing, via the printing device, the surface by sequentially printing at least one print track.

* * * * *